United States Patent [19]

Fry et al.

[11] Patent Number: 4,807,314

[45] Date of Patent: Feb. 28, 1989

[54] TENSIONED BED

[76] Inventors: Steven A. Fry, 30052 Running Deer La., Laguna Niguel, Calif. 92677; Rodney L. Stafford, 4900 E. Chapman #113, Orange, Calif. 92667

[21] Appl. No.: 113,945

[22] Filed: Oct. 28, 1987

[51] Int. Cl.[4] ..... A45F 3/22; A47C 19/00

[52] U.S. Cl. ..... 5/118; 5/122; 5/123; 5/127; 5/187

[58] Field of Search ..... 5/118, 120, 122, 123, 5/127, 129, 187, 211, 216, 440, 110; 297/45

[56] References Cited

U.S. PATENT DOCUMENTS

| | | | |
|---|---|---|---|
| 1,693,564 | 11/1928 | Murphy et al. | 5/122 |
| 1,820,283 | 8/1931 | Mills | 5/187 X |
| 2,011,874 | 8/1935 | Ricketts | 5/187 X |
| 2,348,217 | 5/1944 | Jones | 5/118 |

FOREIGN PATENT DOCUMENTS

| | | | |
|---|---|---|---|
| 549917 | 12/1942 | United Kingdom | 5/187 |

*Primary Examiner*—Michael F. Trettel
*Attorney, Agent, or Firm*—Donald D. Mon

[57] ABSTRACT

A tensioned bed which comprises first and second parallel support rods which can be mounted to a fixed support structure. A flexible rectangular sheet of limited stretchability has a spreader rod attached to one end of the sheet, with the end wrapped about one of the support rods such that the spreader bar extends parallel to the rod. The opposed sheet ends has a hem which receives the other support rod, a pair straps are attached to the spreader bar and extend along and are attached to the sheet sides. The free ends of the straps are engaged by buckles attached to the sheet proximate the hemmed edge.

14 Claims, 3 Drawing Sheets

TENSIONED BED

FIELD OF THE INVENTION

This invention relates to a tensioned bed of the type that can be suspended between two rigid supports to provide a sensibly flat surface for supporting persons or objects, and which is particularly useful in pickup trucks and camper shells.

BACKGROUND OF THE INVENTION

Especially in the field of pickup trucks and campers there is a need for a bed which can readily and reliably be installed and equally readily removed and stored in a very compact space.

This invention has particular attractiveness in pickup truck beds and camper bodies which have been provided with fittings for attachment of various objects such as auxiliary seats and the like, or which can be provided with such fittings. One commonly known set of fittings is shown in U.S. Pat. No. 4,679,840 issued to Steven A. Fry et al on July 14, 1987. It shows a sling-type seat adapted for use in truck and camper bodies, and convenient attachments for the lateral support rods that are used therein. This patent is made a part hereof by reference for its entire showing, and especially of its showing of fitting means for attaching the ends of rods to the body or truck bed.

BRIEF DESCRIPTION OF THE INVENTION

A tensioned bed according to this invention is adapted to be held in tension between a pair of substantially horizontal, parallel, spaced-apart support rods which are fixed to supporting structure such as a pickup truck bed or a camper body. It includes a sheet of flexible cloth having a limited stretch, an axis of length normal to the support rods, and an axis of width parallel to them so as to provide an area for supporting a person or objects placed upon it when the sheet is tensioned. The sheet has a first and a second end parallel to the axis of width and a first and second edge parallel to the axis of length. A first and a second bight is formed at the respective edges by bending the cloth around the respective supports. A pair of straps are provided, each of which is attached to one of said ends, and a buckle is attached to the other of said edges. The straps are held within restraining guides along the sheet edges so as to support these edges, and the straps and buckles are adjustable in tension to tighten the sheet between the supports.

According to a preferred but optional feature of the invention, a spreader bar is fastened along the entire length of each of the ends. The straps are attached to one of the spreader bars and the buckles to the other so that the sheet is tensioned evenly all the way across from edge to edge.

Any economically practical cloth will be stretchable to a limited extent. To reduce sag between the edges, it is a preferred but optional feature to contour at least one edge, and to trap both edges, so that an increased crosswise tension is exerted on the sheet by tightening the straps. Also, because the loads on the sheet, and the tension of the straps will deflect the support somewhat, at least one of the ends will be contoured so as to compensate for this effect, and reduce the sag from end to end.

The above and other features of this invention will be fully understood from the following detailed description and the accompanying drawings, in which:

DETAILED DESCRIPTION OF THE INVENTION

Figure 1:
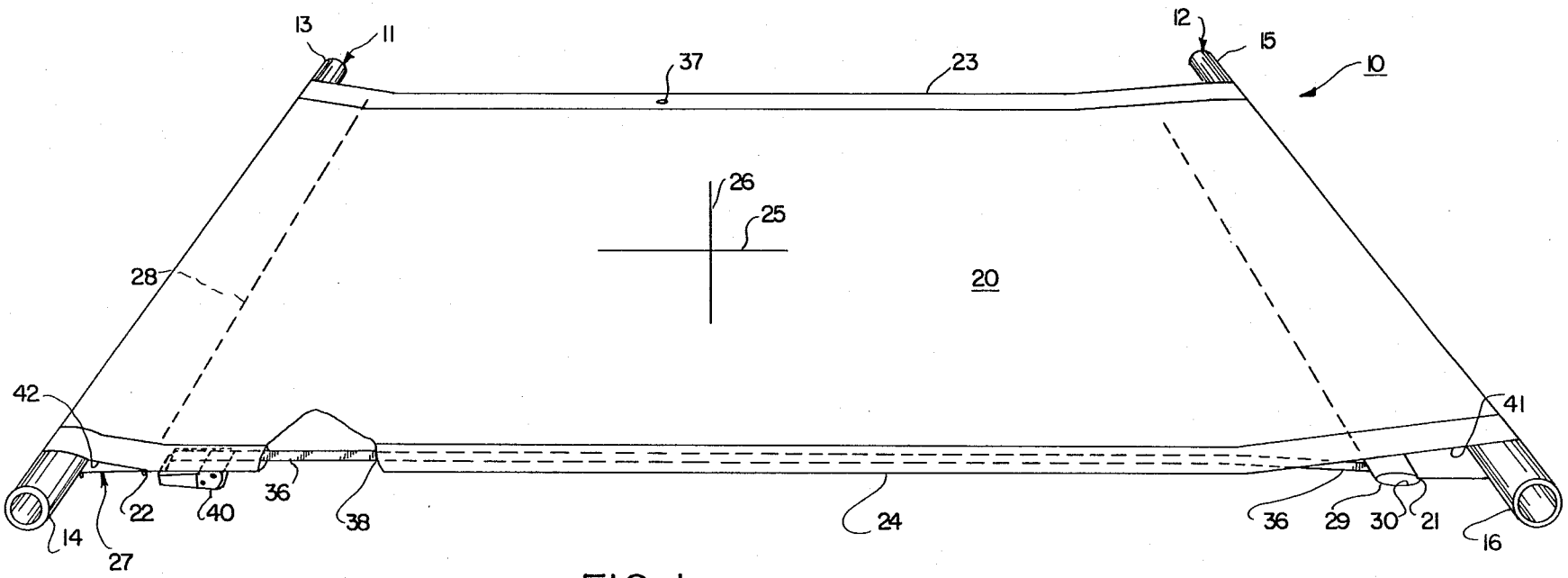
FIG. 1 is a perspective view of the presently preferred embodiment of the invention.
Figure 2:
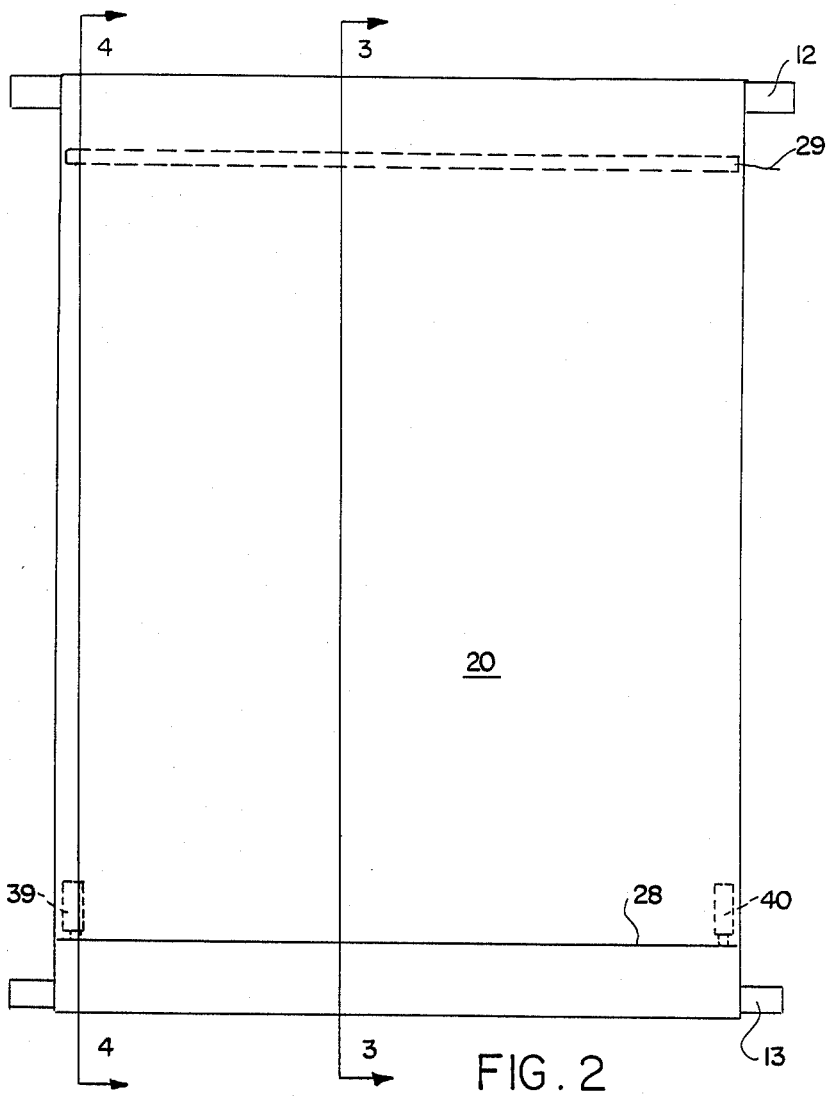
FIG. 2 is a plan view of FIG. 1.
Figure 3:
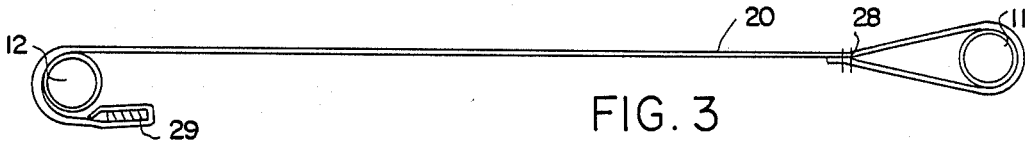
FIG. 3 is a cross-section taken at line 3—3 in FIG. 2.
Figure 4:
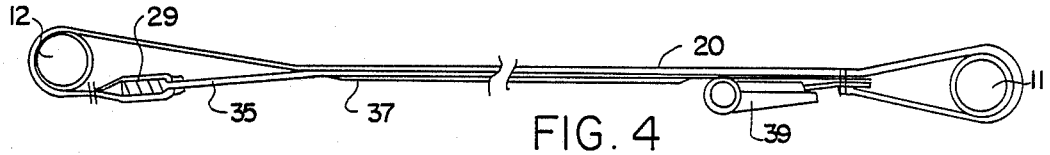
FIG. 4 is a cross-section taken at line 4—4 in FIG. 2.

In FIG. 1 there is shown a tensioned bed 10 according to the invention. It is intended to be stretched between a pair of parallel, spaced-apart support rods 11,12 having ends 13,14,15,16 which are adapted by means not shown to be connected to any desired supporting structure. Examples of such structures are the sides of pickup truck beds and of camper bodies.

The type of attachment is of no importance to this invention, but those shown in the previously identified Fry patent will be found to be very convenient. In many cases it will be found possible to suspend this seat between at least two fittings which are already installed when such devices have previously been used, and in any event additional fittings may be provided as necessary. The support rods may be cut to length, or if preferred it is possible to form them telescopically as shown in said Fry patent to reduce the bulk of the device when stored.

A sheet 20 of flexible cloth has a pair of ends 21,22 and edges 23, 24. It ha an axis of length 25 parallel to the edges and an axis of width 26 parallel to the ends.

The less stretchable the cloth is, the better. However, even very expensive high-density cloths, especially woven cloths, will have some stretchability that under load could result in undesirable sag. Unfortunately the less stetch, the more expensive is the cloth. A good compromise, which makes a very suitable tensioned by to a cross-woven cloth made of solid core extruded filament polypropylene. One set of strands will ordinarily be aligned with the axis of length.

End 22 is bent to form a loop 27 which is stitched by a straight stitch 28. Rod 11 fits in this loop and extends beyond the edges of the sheet.

End 21 is bent around rod 12 when the bed is installed. It includes a rigid spreader 29, usually a square-sectioned bar, stitched inside a loop 30.

A first strap 35 and a second strap 36 are attached to end 21 by strong stitches for the purpose of placing the sheet in tension. Each strap extends along its respective edge in respective restraining guides 37, 38. While the guides may be simple circlips or the like, for reasons yet to be described it is preferable to form a "tunnel" by forming a hem in the cloth material itself to receive the strap in order to give a continuous rather than a discontinuous support to the sheet at the edge. In whatever event, the free end of the strap emerges from its respective guide near the other end. Near this free end buckles 39,40 are attached to end 22 by strong stitches. The buckles need not be attached directly to the "literal" end 22. Instead, the term "end" is intended to mean a location where the buckle is anchored by support rod 11 so that when the strap is tightened, the sheet is drawn in tension around support rod 12.

The buckles are a releasable type buckle so that the bed can be dismounted. It is also a high tension ratchet style buckle which can be "cranked" to tighten the straps.

It will now be seen that the device will be installed by having the supports in position and the buckles unfastened. Support rod 11 will be in loop 27, and end 21 will be drawn around support rod 12. The straps are threaded through the guides, attached to the buckles, and the buckles are then tightened down. The bed is now a firmly installed, reliable, tensioned sheet device which has good side-to-side support and exceptionally good longitudinal support provided by the strongly tensioned straps at the side.

The spreader bars, while optional, contribute very favorably to the spreading of the tension evenly across the width of the bed. This will be found to be a surprisingly effective supporting surface, remaining quite flat despite the exertion of substantial loads on it.

To remove the bed it is only necessary to unfasten the buckles and release the strap. It may be preferred simply to loosen the buckles and remove the support rods from the truck from one camper body and leave them in the sheet for storage. Persons utilizing this bed will soon decide for themselves the most convenient means for installing it and removing it.

Figure 5:
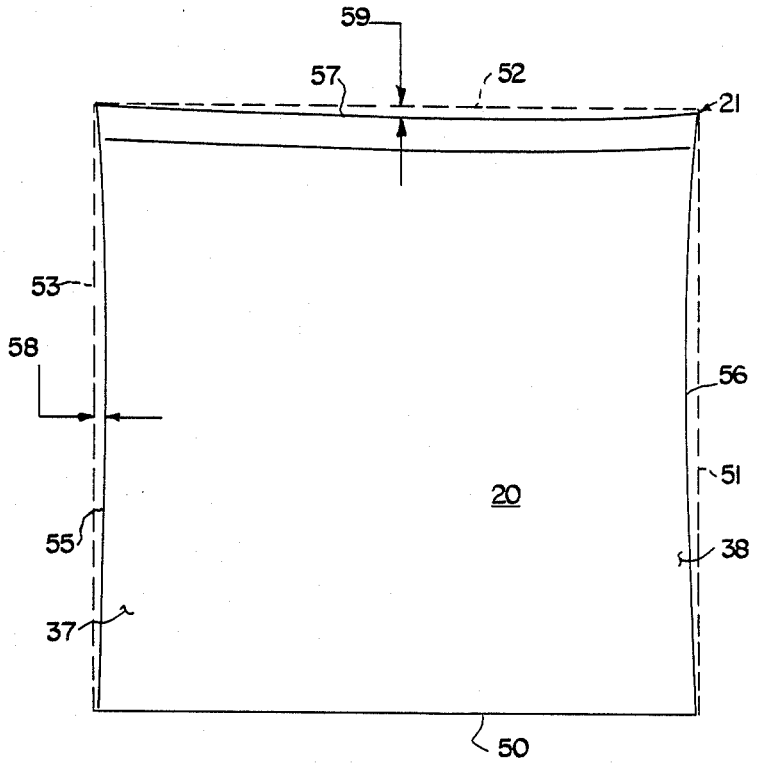
FIG. 5 is a layout of the sheet, showing a contouring of its sides and of one of its edges.

The bed as already described is suitable for its purpose, but depending on the cloth may tend to sag undesirably under load. FIG. 5 illustrates a means to minimize the sagging. There will always be some, because the material is not rigid. However, it is possible to reduce it greatly.

FIG. 5 is a flat layout of the sheet itself without the spreader rod. It is a true rectangular shape consisting of solid line 50 and three dashed lines 51,52 and 53. If desired, the cloth could be cut to this rectangular shape. However it is done, when the stitching is done, end 21 and edges 23 and 24 will be shaped away from a true straight edge.

Restraining guides 37 and 38, shaped as tunnels, will have been formed on concave curves 55,56. Each is spaced at it center from the true rectangular edge by about one-half inch (58) along a space of about 6 feet, and a width of about 3½ feet. When the straps are placed in tension, they tend to straighten the tunnels, and stretch the cloth cross wise by pulling it toward a straight line, placing it in greatest tension at the center, with decreasing tension toward the ends. As a consequence, the center of the bed is variously pre-tensioned across the sheet, and sag is reduced along that dimension. Only one edge need be formed this way, but it is best practice to contour both of them.

The tension on the support rods caused by the straps and by a load laid on the sheet will cause some bending of the support rods, and also of the spreader. This would result in end-to-end sag. This can be compensated by contouring at least one of the ends. It will usually be end 21, because in use it is not visible. Stitches 57, which form loop 27 are visible, and for this reason will usually be straight. Loop 30, however, is stitched to form a concave curve 57 as viewed in a flat layout, diverging about ¼ inch (57) at the center of a 3½ foot wide span from a straight edge. The spreader will be placed in this loop. When the straps are tightened and the sheet loaded, the center will be pre-tensioned along its end-to-end dimension, with the greatest tension at the center. This will compensate for a large amount of the anticipated sag.

The above arrangement, otherwise stated, is that the sheet is narrower at the middle than at the ends, and shorter in the middle than at the edges, and this is accomplished in a relatively smooth curve.

There is provided an inexpensive and effective tensioned bed which is efficient and readily installed, removed, and stored.

This invention is not to be limited by the embodiments shown in the drawing and described in the description which are given by way of example and not of limitation, but only in accordance with the scope of the appended claims.

I claim:

1. A tensioned bed comprising:
   - a first and a second support rod adapted to be mounted to fixed structure, extending parallel to one another;
   - a flexible sheet with limited stretchability, having a dimension of length and width, a pair of edges and a pair of ends, said sheet being adapted to be bent around each of said support rods;
   - a spreader rod attached to at least one of said ends extending parallel to said spreader rods;
   - a strap extending along and attached to each of said edges, said straps being attached to one of said sheet ends and having a free end; and
   - a pair of buckles attached to the other of said sheet ends, each adapted to engage and hold a respective free end of a strap in tension.

2. A tensioned bed according to claim 1 in which restraining guides attach said straps to said edges.

3. A tensioned bed according to claim 2 in which said restraining guides are tunnel-like, extending along a major portion of the length of its respective edge, said straps passing though said guides.

4. A tensioned bed according to claim 3 in which said restraining guides are formed as concave curves in flat layout view.

5. A tensioned bed according to claim 3 in which said restraining guides are formed as a loop-like hem along said edges.

6. A tensioned bed according to claim 1 in which at least one of said ends is formed as a concave curve in flat layout view.

7. A tensioned bed according to claim 1 in which said spreader rod is held inside a loop formed as a stitched hem at its respective end.

8. A tensioned bed according to claim 7 in which its respective end is, without the spreader rod, formed as a concave curve in flat layout view.

9. A tensioned bed according to claim 8 in which tunnel-like restraining guides extend along a major portion of the length of the respective edge, said straps passing through said guides.

10. A tensioned bed according to claim 9 in which said restraining guides are formed as concave curves in flat layout view.

11. A tensioned bed according to claim 9 in which said restraining guides are formed as a loop-like hem along said edges.

12. A tensioned bed according to claim 11 in which at least one of said ends is formed as a concave curve in flat layout view.

13. A tensioned bed according to claim 12 in which said buckles are releasable ratchet types.

14. A tensioned bed according to claim 13 in which said spreader rod is rectangular in cross-section.

* * * * *